United States Patent [19]

Glaser et al.

[11] 4,139,050

[45] Feb. 13, 1979

[54] CONTROL OF DISCHARGE OUTLET OF A CASTING VESSEL

[75] Inventors: Josef Glaser, Dusseldorf; Karl H. Koch; Johannes Kurth, both of Duisburg, all of Fed. Rep. of Germany

[73] Assignee: Mannesmann Aktiengesellschaft, Dusseldorf, Fed. Rep. of Germany

[21] Appl. No.: 825,028

[22] Filed: Aug. 16, 1977

[30] Foreign Application Priority Data

Aug. 18, 1976 [DE] Fed. Rep. of Germany ..... 2637548

[51] Int. Cl.[2] ..... B22D 11/10

[52] U.S. Cl. ..... 164/437; 164/335

[58] Field of Search ..... 164/155, 335, 337, 439, 164/437; 222/601, 602

[56] References Cited

U.S. PATENT DOCUMENTS

| | | | |
|---|---|---|---|
| 2,113,894 | 4/1938 | Lucier | 222/602 |
| 2,753,605 | 7/1956 | Carleton | 164/337 X |
| 3,063,109 | 11/1962 | Rapaport | 164/337 X |
| 3,157,923 | 11/1964 | Hodler | 164/337 |
| 3,536,124 | 10/1970 | Hanas | 164/437 X |
| 3,744,684 | 7/1973 | Heimgartner | 222/602 |
| 3,788,382 | 1/1974 | Daniel et al. | 164/155 X |

FOREIGN PATENT DOCUMENTS

| | | | |
|---|---|---|---|
| 2435485 | 2/1976 | Fed. Rep. of Germany | 164/437 |
| 320832 | 5/1957 | Switzerland | 164/155 |

*Primary Examiner*—J. Howard Flint, Jr.

*Attorney, Agent, or Firm*—Smyth, Pavitt, Siegemund, Jones & Martella

[57] ABSTRACT

The plug lifting structure for a stopper in a tundish is coupled, via a single, mechanical connection point, to a hydraulic actuator rod being part of the casting stand, so that removal of the tundish merely requires lowering of that rod to separate the control connection.

9 Claims, 3 Drawing Figures

CONTROL OF DISCHARGE OUTLET OF A CASTING VESSEL

BACKGROUND OF THE INVENTION

The present invention relates to the control of the plug or stopper for the casting outlet of a casting vessel such as a tundish particularly of the type which cooperates with a mold or molds for continuous casting.

The German printed Patent Application 2,435,485 discloses a control in which the level of the bath of molten metal in a machine for continuous casting is monitored, and electrical signals are provided being indicative of the level and of any changes of that level therein. The signal is used to raise or lower a plug which controls the casting outlet of a tundish which feeds molten steel into a mold.

Independent from the foregoing, it is generally known to construct and to mount a tundish feeding a mold for continuous casting, to be displaceable; that is to say, the tundish may, for example, be constructed for being lifted or lowered and for being laterally displaceable or pivotable. Thus, there is no fixed association and connection between tundish and mold. Rather they are mounted for a relative and independent displacement. This is particularly important in the case of sequence casting in which the tundish wears rather rapidly, is more easily damaged and subjected to other interferences as well, all of which being instances which require more or less rapid and more or less frequent exchange of the tundish.

This independence of tundish and mold(s) is operationally not maintained if a closed loop control is included for lowering and raising the plug. Such closed loop requires electrical, mechanical and/or hydraulic connection of the tundish with associated equipment and of the casting stand, particularly the mold, because the plug is part of the tundish and at least some of the control apparatus including particularly the device monitoring the level of the bath in the mold is inherently structurally combined with the mold. Thus, whenever the tundish is to be replaced these connections must be interrupted. If one considers further that a tundish usually does not just feed a single mold but several, possibly even many molds each of them requiring its own control loop, one can readily see that the total amount of mechanical, electrical, and/or hydraulic connection is significant and errors are more likely to occur upon reconnecting the system. Another aspect is that the actuating mechanism for the plug such as a hydraulic drive being in physical proximity of the casting process is very much endangered for a variety of reasons, such as sputtering off steel, heat, etc.

DESCRIPTION OF THE INVENTION

It is an object of the present invention to avoid the deficiencies and drawbacks outlined above and to establish the possibility of disconnecting the tundish from the mold with a minimum of disconnection as far as the plug operating mechanism is concerned.

It is another object of the present invention to construct the actuation and control mechanism for a plug of a tundish in such a manner that damages to the equipment is minimized and the construction inherently involves protection of endangered equipment.

In accordance with the preferred embodiment of the present invention, the plug is suspended from a transverse arm which is mounted on an up and down sliding, spring biased rod as is known per se. The guide for the rod, the springs and the arm are all part of the tundish. Separately therefrom actuating means are provided, particularly a hydraulic drive being connected to the casting stand of which the mold is a part. A simple plug-in type connection connects an actuating element of the actuator means such as the piston rod of the hydraulics, either directly or through a separate linkage to the spring biased rod. The linkage if permitted includes pivoting of the plug connection to account for lateral misalignments of the tundish in the stand, and to permit greater freedom in the removal of the tundish. The plug-in connection includes mating plug elements by means of which the lower end of the rod on the tundish can be connected to the actuating means e.g., the hydraulics. The particular plug connection is, therefore, the sole link between the electro mechanical level control and actuation equipment on one hand and the plug being actuated on the other hand. The disconnection is effected simply by lowering the hydraulic actuator between a closing position of the stopper. As a further improvement, it may be advisable to provide additional load relief for the piston rod so that the hydraulic is more sensitive and does not have to overcome the full force of the spring; the springs are usually rather stiff to be able to force the plug positively into a closing position.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawngs, FIGS. 1 and 2 illustrate a tundish 12 of a construction known per se and which is not shown in complete detail. The particular tundish may have one or serveral outlets or exit openings 13 which are closed or can be closed by means of a plug element or elements 14.

Figure 2:
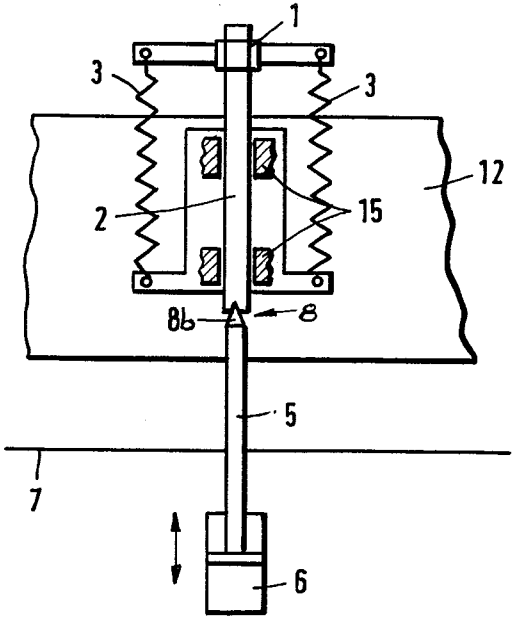
FIG. 2 illustrates a side view of a portion of FIG. 1.

The plug element or stopper 14 is suspended from a traverse 1 which, in turn, is held by and on a rod 2 in cantilever fashion. The rod 2 is slidably disposed in a guide track 15 permitting up and down movement of the rod 2 to lower or raise the traverse 1 so that in fact the stopper 14 can be lowered or lifted. The guide track 15 is part of the tundish and is connected thereto. The traverse 2 is biased by a pair of springs 3 in such a manner so that stopper 4 closes the opening 13. The stopper will be lifted against the force of the springs 3. The lower ends of the springs, not connected to the traverse, are connected to the tundish.

The lower end of the rod 2 is funnel shaped in a concave manner and forms a female part 8*a* of a plug connection 8. The elements 1 and 2 constitute a moving and displacement structure for the stopper 14 and having a single mechanical input point, coupling part 8a. The conical peak 8b of a piston rod 5 enters the conical indent 8a or rod 2 to complete the connection 8. The double arrow indicates that lowering of rod 5 breaks the connection 8 simply by pulling part 8b out of indent 8a.

The teeming platform indicated by reference numeral 7, and a hydraulic actuator 6 with a piston of which 5 is a piston rod, is disposed below that platform 7, quite protected from the casting and steel pouring as such. The hydraulic drive 6 is controlled by means of a circuit known per se and shown only schematically. That control circuit has an input device and sensor or detector 16 which responds to the level of molten metal in the mold 17. The output of detector 16 is amplified in circuit 16a whose output in turn controls valves 6a. These valves feed or discharged hydraulic fluid to and from the cylinder chambers above and below the piston thereon, so that rod 5 is driven up or down. That in turn controls the pouring flow into the mold 17 from the tundish 12. A continuously cast ingot 18 is withdrawn in a conventional manner from the mold 17.

Figure 3:
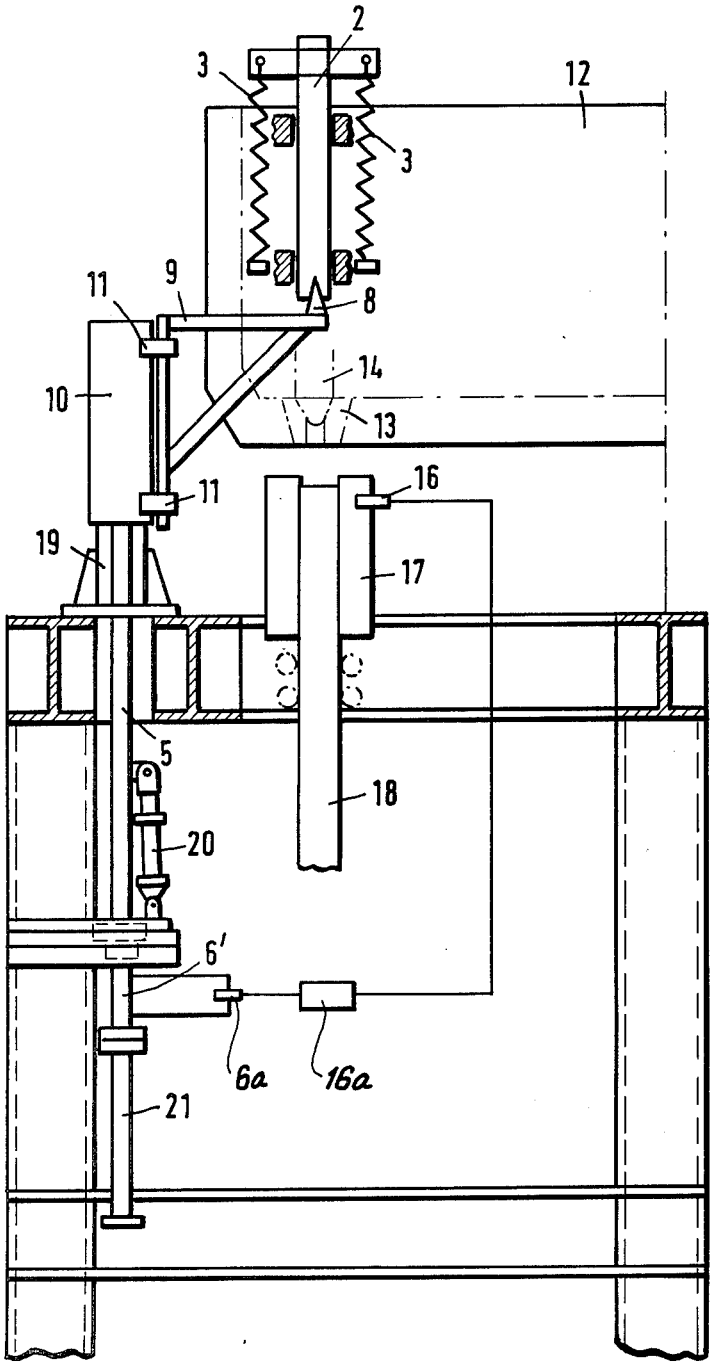
FIG. 3 illustrates a tundish together with more extensive equipment for stopper operation, being designed for compensating lateral misalignment of the tundish in the casting stand.

Turning now to FIG. 3, the construction features as far as the suspension of the plug 14 is concerned are essentially the same, up to the vertical rod 2 having a negative concial opening 8a at its bottom to establish the female member of the plug-type connection 8. The male conical plug element 8b is mounted on a transverse arm 9 which is hinged by means of hinge elements 11 to a holder or carriage 10. The element 10 and, therefore, the transverse arm 9 are movably disposed for moving in a vertical direction. Particularly, element 10 has internal guideways for receiving flat rods 19, being stationary on platform 7.

Holder or carrier 10 is connected to the end of a piston rod 5' which is actuated by a hydraulic drive 6'. This hydraulic drive is also operated by a control means that includes the sensor 16, amplifier 16a and valve control 6a. Thus, the hydraulics are controlled here also in dependence upon monitoring the bath level in mold 17. Thus, the basic construction is similar to FIGS. 1 and 2. The stopper lifting mechanism is associated with the tundish and a hydraulic actuator with electrical input control is associated with the casting stand. Thus, the basic configuration is similar to FIGS. 1 and 2; only the linkage is different, using hinging for greater freedom in effecting the connection and tundish removal. There is, however, still another difference. In FIG. 3, the hydraulic drive 6' does not have to overcome the full load of the springs 3 (plus stopper weights).

First of all, an actuating cylinder and drive 21 is provided underneath the hydraulic drive 6' and in axial alginment therewith. The drive 21 when actuated urges the holder 10 up to complete the connection 8, without, however, overcoming the force of springs 3, i.e., without lifting the stopper. This increases, in fact, the sensitivity of the controlled actuation to be provided by the drive 6'. In addition, a pneumatic cylinder 20 acts as load relief and holds and suspends in effect the entire device 5, 10, 11, 9, 2, 1, 14. Moreover, pneumatic drive 20 compensates the force of springs 3 when the stopper 14 is initially lifted to open the outlet 13. Hydraulic drive 6' merely augments the lifting operation if needed due to signalling from sensor 16 as regards the level changes. Thus, drive 6' acts as a rather sensitive, fine position control.

The equipment illustrated in the several figures operates as follows: the tundish 12 is at first prepared in the conventional manner for a casting process including particularly preheating. The tundish is to remain closed so that the force of the spring 3 urges the stopper 14 into the outlet 13 of the tundish. The tundish is then moved into the casting stand and into a position above the mold which is mounted separately in the stand, and the tundish is in particular adjusted so that the outlet 13 registers with the opening of the mold underneath. Now the hydraulic drive 6 as per FIGS. 1 and 2 (but not as per FIG. 3) raises the arm 5 hydraulically through a first displacement range to engage rod 2 by establishing the connection 8. The hydraulic will be stopped upon completion of coupling, thus maintaining a position in which it does not act against the springs 3 so that the stopper closing force established by them is not diminished. Analogously, in FIG. 3 drive 21 raises the holder 10 and arm 9, and again the plug connection to rod 2 is established therewith, but in this case without participation of the hydraulic cylinder 6. Also in this case the plunger or stopper 14 is not lifted, nor is the spring bias partially or even completely compensated. Rather the equipment is now ready for filling.

Next, the tundish 12 is filled with molten metal and upon filling or upon completion of filling, hydraulic drive 6 (FIGS. 1 and 2) raises the actuator rod 5 into a second displacement range thereby displacing rod 2 to lift the stopper 14. This operation of the hydraulic 6 may be carried out under open loop conditions. Once the casting process has begun, the closed loop operation takes over for supervising the level of molten metal that is being poured into mold 17. In the embodiment of FIG. 3, actuation of pneumatic 20 lifts the stopper by carrying tha load and overcoming the spring bias. Hydraulic drive 6' may take over partially only when closed loop operation is desired.

Figure 1:
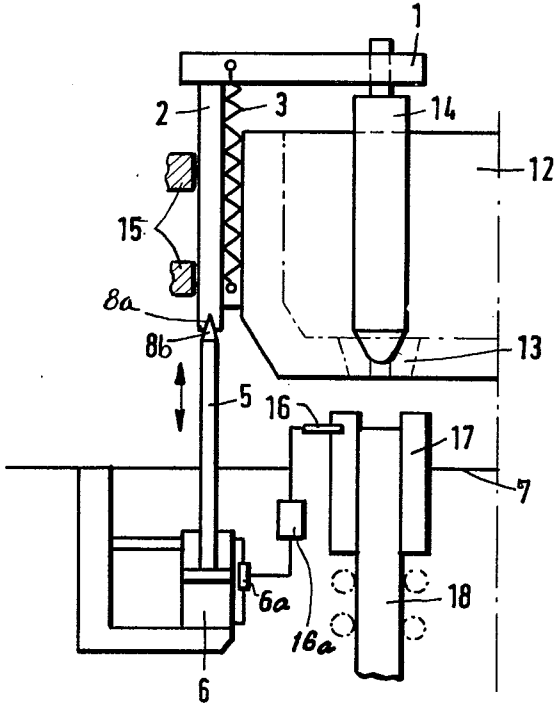
FIG. 1 illustrates a tundish or distributor in a machine for continuous casting and in front view.

As the casting process is terminated for any reason including, for example, that the ladle or tundish is empty, the stopper 14 is lowered by the hydraulic 6 in FIG. 1, or the pneumatic drive 20 as per FIG. 3. As per FIGS. 1 and 2, the hydraulics may continue to retract the rod 5 to disconnect connection 8. As per FIG. 3, disconnection is obtained by deactivating drive 20. In either case, the disconnection may be carried out only if the tundish is to be removed. If the tundish is just closed to be refilled, connection 8 is maintained in the manner described.

If the tundish or ladle 12 is to be exchanged, the plug connection 8 is disconnected so that the tundish with apended equipment including the arms 2 and 1 can simply be removed. The device as per FIG. 3 is of particular advantage from that point of view in that in addition the arm 9 may be pivoted out of the way to make more freedom available, i.e., as to the direction of removal and movement of tundish 12.

The invention is not limited to the embodiments described above, but all changes and modifications thereof not constituting departures from the spirit and scope of the invention are intended to be included.

We claim

1. Apparatus for the control of a plug for the casting outlet of a removable tundish cooperating with a mold for continuous casting the mold being positioned in a casting stand, comprising:

a transverse arm suspending the plug;

a first, vertically extending and vertically movable rod, said arm being mounted on said first rod so that the plug moves up or down as the first rod moves up or down;

spring means for biasing the first rod tending to move the first rod and the plug down into closing position of the casting outlet of the tundish;

said arm, first rod and spring means being mounted to the tundish and movable and displaceable therewith;

hydraulic drive means connected to the casting stand and operating a piston rod in up or down direction;

control means on the stand for controlling the hydraulic drive means in dependence upon casting by the mold; and connecting means including a plug connection for disconnectably connecting the piston rod to the first rod on which the arm is mounted, the connection and disconnection resulting, respectively, from up and down movement of the piston rod.

2. Apparatus as in claim 1 wherein the piston rod and the first rod are vertially aligned, the piston rod being provided with one part of the plug connection, the first rod being provided with another part of the plug connection mating the one part.

3. Apparatus as in claim 1 wherein the means includes a holder, the piston rod carrying the holder; the means includes further a second transverse arm being hinged to the holder, the second transverse arm being provided with one part of the plug in connection, the first rod being provided with another part of the plug connection mating the one part.

4. Apparatus as in claim 1 including drive means for relieving the hydraulic means in parts as regard to overcoming the force of the spring means.

5. Control apparatus for a stopper in a tundish removably positioned in relation to a mold for continuous casting comprising:

a stopper moving structure including a connection point that can be lowered or raised for moving the stopper, the stopper moving structure being connected to the tundish;

an actuator mounted in fixed relation to the mold and having an up and down movable output element, operating in a first displacement range and in a second displacement range adjacent the first range; and a connecting element on the movable output element of the actuator and which is disconnected from the connection point of the stopper moving structure in the first displacement range, and connected to the connection point in the second range thereby to cause variable positioning of the stopper.

6. Control apparatus as in claim 5, the output element being hinged to adjust lateral alignment between the vertical displacement of the actuator and the vertical displacement of the moving structure.

7. Control apparatus as in claim 5, the actuator being a single hydraulic drive.

8. Control apparatus as in claim 5, the actuator including a first drive for stopper control, and drive means for moving the element through the first range.

9. Control apparatus as in claim 5, and including biasing means tending to force the stopper down thereby maintaining the connection between the connecting point and the connecting element in said second range.

* * * * *